US006508060B2

(12) United States Patent
Clemens et al.

(10) Patent No.: US 6,508,060 B2
(45) Date of Patent: Jan. 21, 2003

(54) STEAM MOTOR

(75) Inventors: Herbert Clemens, Berlin (DE); Michael Hoetger, Berlin (DE)

(73) Assignee: Enginion AG, Berlin (DE)

( * ) Notice: Subject to any disclaimer, the term of this patent is extended or adjusted under 35 U.S.C. 154(b) by 0 days.

(21) Appl. No.: 10/086,858

(22) Filed: Mar. 4, 2002

(65) Prior Publication Data

US 2002/0194848 A1 Dec. 26, 2002

(30) Foreign Application Priority Data

Jun. 26, 2001 (DE) ..... 201 10 553

(51) Int. Cl.[7] ..... F01K 1/00
(52) U.S. Cl. ..... 60/670; 60/643
(58) Field of Search ..... 60/670, 645, 643

(56) References Cited

U.S. PATENT DOCUMENTS

| | | | | |
|---|---|---|---|---|
| 3,084,677 A | | 4/1963 | Mitchell | |
| 3,744,940 A | | 7/1973 | Pierce et al. | |
| 3,749,079 A | * | 7/1973 | Gudmand-Hoyer | 122/161 |
| 3,806,286 A | | 4/1974 | Granberg | |
| 3,890,071 A | | 6/1975 | O'Brien | |
| 3,908,602 A | * | 9/1975 | Brulfert et al. | 122/367.4 |
| 4,047,856 A | | 9/1977 | Hoffman | |
| 4,311,010 A | * | 1/1982 | Wurmfeld | 60/641.8 |
| 4,520,765 A | * | 6/1985 | Gerace | 123/27 R |
| 4,550,694 A | * | 11/1985 | Evans | 123/41.02 |

FOREIGN PATENT DOCUMENTS

| | | |
|---|---|---|
| DE | 4022632 | 10/1993 |
| DE | 4422720 | 1/1996 |
| DE | 19522268 | 1/1996 |
| DE | 20012430 | 11/2000 |

OTHER PUBLICATIONS

Buschmann et al.; *Zero Emission Engine—The Steam Engine with Isothermal Expansion*; MTZ Motortechnische Zeitschrift, vol. 61, No. 5 (2000); F. Vieweg & Son, mbH, Wiesbaden, Germany; pp. 314–323.

* cited by examiner

*Primary Examiner*—Hoang Nguyen
(74) *Attorney, Agent, or Firm*—James Creighton Wray; Meera P. Narasimhan

(57) ABSTRACT

In a steam motor with a piston engine, the piston engine is included in a closed steam circuit. This steam circuit includes a steam generator, a steam injector for injecting steam into the piston engine, a condenser for condensing the steam emerging from the piston engine to condensed water, and a water feeding pump for feeding the condensed water to the steam generator. The steam generator is heated by hot combustion gas from a combustion unit. The combustion unit burns fuel. The fuel is mixed with fresh air supplied by an air feeding device through a fresh air passage. The fresh air passage usually contains a first heat exchanger for pre-heating the fresh air by heat from the expanded steam emerging from the piston engine, and a second heat exchanger for pre-heating the fresh air by heat from hot waste gas emerging from the steam generator. In order to provide a particularly compact steam motor without adversely affecting the efficiency, a rotary piston engine is used as piston engine.

16 Claims, 2 Drawing Sheets

STEAM MOTOR

This application claims the benefit of German Application No. 201 10 553.3 filed Jun. 26, 2001.

BACKGROUND OF THE INVENTION

The invention relates to a steam motor with a piston engine. The piston engine is included in a closed steam circuit. This steam circuit includes a steam generator, a steam injector for injecting steam into the piston engine, a condenser for condensing the steam emerging from the piston engine to condensed water, and a water feeding pump for feeding the condensed water to the steam generator. The steam generator is heated by hot combustion gas from a combustion unit. The combustion unit burns fuel. The fuel is mixed with fresh air supplied by an air feeding device through a fresh air passage. The fresh air passage usually contains a first heat exchanger for pre-heating the fresh air by heat from the expanded steam emerging from the piston engine, and a second heat exchanger for preheating the fresh air by heat from hot waste gas emerging from the steam generator.

Such a steam motor of this type is described in detail in papers "Zero Emission Engine—Der Dampfmotor mit isothermer Expansion", MTZ Motortechnische Zeitschrift 61 (2000), 5 and "Der Dampfmotor—Entwicklungsstand und Marktchancen", MTZ Motortechnische Zeitschrift 62 (2001), 5. The steam motor has a three-cylinder reciprocating piston engine.

In this prior art steam motor, the fuel is burned in a pore burner (CPS cell). This is a thermal reactor wherein the combustion process takes place within a porous, ceramic matrix. The distribution of the pore size can be such that a large spectrum of fuels such as natural gas, hydrogen, propane, butane and all automobile fuels can be used. Such a pore burner is described in U.S. Pat. No. 5,522,723 issued on Jun. 4, 1996 to Franz Durst et al. The disclosure of this patent is incorporated in the present specification by reference.

The steam motor described in the prior art mentioned above was, at first, conceived as a drive engine for motor cars. In the second-mentioned paper, the usefulness of the steam engine in block heating power stations or as auxiliary power units (APU) is mentioned. The particular advantages of this steam motor are low emissions without after-treatment of waste gas, high torque, flexibility with regard to fuels, variable coupling-out of thermal and mechanical energy, good efficiency, low noise and oil-free operation of the whole system The prior art steam motor suffers from the disadvantages, that it is bulky because the reciprocating piston engine is bulky itself and also because of the components required for steam generation and heat retrieval, and, therefore, can be used only where sufficient space is available. Therefore, the prior art steam motor is less suitable for the use as APU, which has to meet high demands with regard to compactness.

SUMMARY OF THE INVENTION

It is an object of the invention to provide a particularly compact steam motor without adversely affecting the efficiency as compared to the prior art steam motor.

To this end, a rotary piston engine is used as piston engine, instead of the reciprocating piston engine of the prior art steam motor. Such a rotary piston engine has high power density in relation to the space required. Furthermore, the additional systems required for the steam generation can be assembled in a much more appropriate and space-saving way around the rotary piston engine, whereby a extraordinarily compact and rugged unit is obtained. Such unit is particularly adapted for use as APU. A further advantage is that such steam engine does not generate vibrations, as there are no reciprocating masses. The rotary masses can be completely balanced. In addition, higher efficiency can be expected.

The term "rotary piston engine" as used herein in contrast to "reciprocating piston engine" is to include all types of engines in which the pressure of the steam or other pressurized fluid acts on surfaces of a rotor.

Further objects and modifications of the invention will be apparent to those skilled in the art when reading the following description of a preferred embodiment in conjunction with the accompanying drawings.

Embodiment if the invention are described in greater detail herein below with reference to the accompanying drawings.

DETAILED DESCRIPTION OF THE PREFERRED EMBODIMENTS

Figure 1:
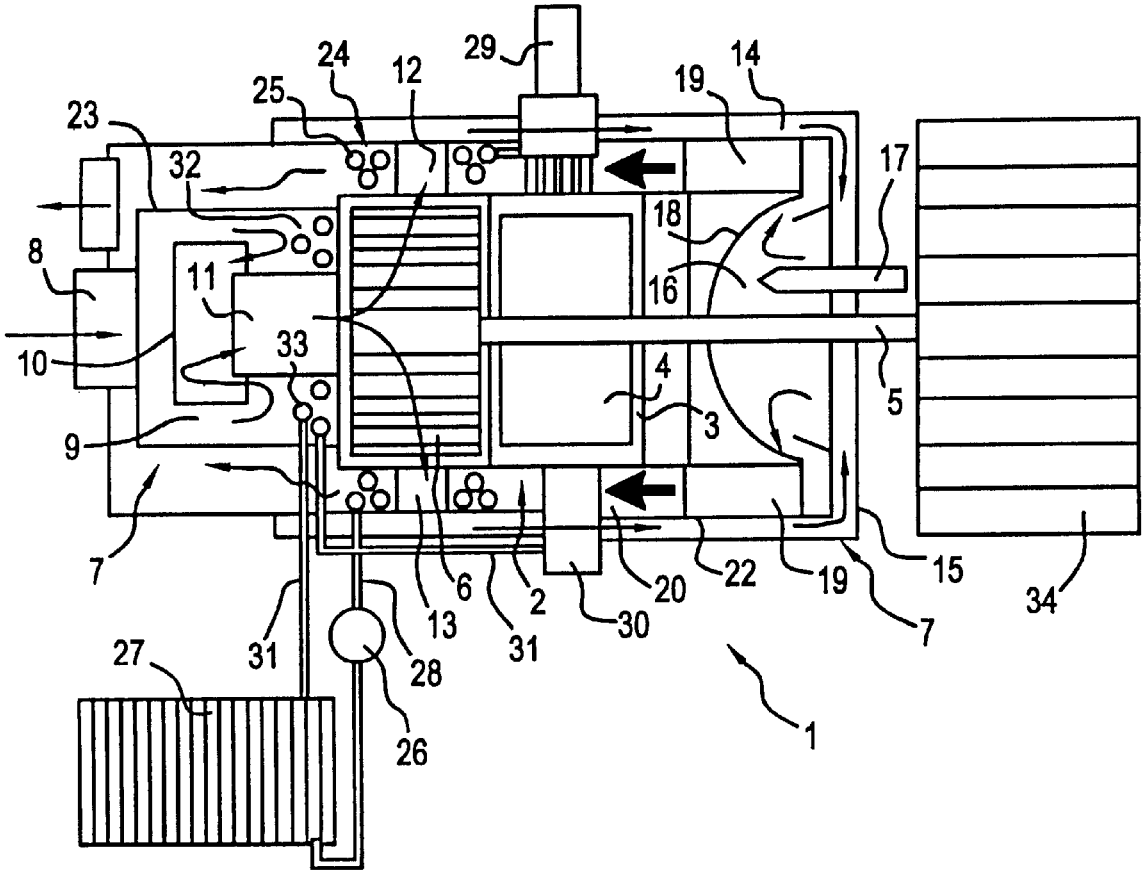
FIG. 1 is a longitudinal, sectional view of a steam motor of the invention comprising a rotary piston motor with a rotor of the wanel-type.

The steam engine 1 illustrated in FIG. 1 and adapted for use as APU has, as its central component, a rotary piston engine of the Wankel-type. The rotary piston engine 2 has a housing 3, in which a three-arced rotor is mounted, this three-arced rotor having the function of a piston. On its inner side, the rotor meshes with a central drive shaft 5, which extends from the housing at both ends. The details of the kinematic coupling are not shown in detail, as they are known from the Wankel motor and will be apparent to a person skilled in the art.

A radial compressor 6 is mounted on the lefthand end of the drive shaft 5, as viewed in FIG. 1. The radial compressor is located in a fresh air passage, which is generally designated by 7. This fresh air passage 7 begins with a central intake opening 8. This intake opening communicates with a downstream filter (not shown). The intake opening communicates with a first annular section 9. The annular section 9 is formed, at its end adjacent the radial compressor 6, to deflect the fresh air about 180°. A cup-shaped baffle 10 provides for a further deflection of the fresh air through 180°, whereby the fresh air flows into a central intake passage 11, which opens into the radial compressor. The radial compressor 6 deflects the axially entering fresh air radially outwards. The fresh air then gets, through a plurality of connecting passages 12, 13, which are distributed over the circumference of the radial compressor, into an outer, annular fresh air passage section 14. This annular fresh air passage section 14 surrounds the rotary piston engine 2 and extends up to an end plate 15 of the steam motor. There, the fresh air flows radially inwards into a hemispherical fuel-air mixing chamber 16, the wall of the mixing chamber 16 being curved towards the rotary piston engine 2. A fuel injector 17 extends into the mixing chamber 16.

An appropriate fuel is injected into the fresh air through the fuel injector, the quantity of the selected such that an ignitable and burnable mixture is formed in front of the arcuate or hemispherical wall 18. This mixture flows radially outwards, as indicated by arrows, into an annular pore burner 19 of porous, ceramic material. In the pore burner 19, the mixture is burnt without open flame with a highly homogeneous temperature distribution between 1200 and 1300° C. The hot gas formed thereby flows into an annular hot gas passage 20. The annular hot gas passage is defined, on its outside, by a cylindrical wall 21. This cylindrical wall, at the same time, forms the inner wall of the annular fresh air passage section 14. In this way, the entering fresh air is pre-heated.

The annular hot gas passage 20 surrounds both the rotary piston engine 2 and the radial compressor 6. Thanks to the common partition, there is a transfer of heat to the fresh air. The hot gas flows also around the connecting passages 12, 13. Subsequently, the hot gas flows also along the common cylindrical wall 22 between the first annular passage section 9 and the annular hot gas passage 20, which also results in heat transfer to the fresh air. The hot gas or waste gas, respectively, then emerges through the waste gas outlet 23 to atmosphere. Depending on the installation site, a waste gas tube may communicate with the waste gas outlet 23. As the fuel burns in the pore burner virtually emission free-apart from $CO_2$—no waste gas treatment, for example by means of catalysts, is required.

The steam for the drive of the rotary piston engine 2 is generated in a closed steam circuit. The steam circuit is provided with a steam generator 24 consisting of a circular bundle of tubes 25, which is arranged in the hot gas annular passage 20 around the housing of the radial compressor 5 on both sides of the connection passages 12, 13. Water from a condenser 27 is pressurized by a water supply pump via a tube 28 to a nominal pressure, for example 50 bar (300 to 500 bar is also possible) and pumped into the steam generator 24. There the water is completely vaporized under the influence of the hot gas flowing through the hot gas annular passage 20 and heated to a Temperature of 500° C.

The steam leaves the bundle of tubes 25 and enters a steam injector 29 arranged on the housing 3 of the rotary piston engine 2 and is also exposed to hot gas. The steam is overheated by further 150 to 400° C. depending on the load and the rotary frequency and is injected in a controlled manner into the rotary piston engine 2. The rotor 4 is driven by its expansion. The housing 3 is further heated by the hot gas passing on its outside, such that an almost isothermal expansion is achieved.

On the lower side of the rotary piston engine 2 a steam outlet 30 is arranged, where the expanded steam flows into an exhaust steam tube 31. It leads to an exhaust heat exchanger 32, which also is formed as an annular bundle of tubes 33 and which is arranged in the first annular passage 9 of the fresh air passage 7. In such way the fresh air is heated and the steam is cooled down. The steam enters a condenser 27 through an extension of the exhaust steam tube 31 is there condensed by means of cooling water and collected in a reservoir which is not shown here in detail. The condensing process is supported by cooling water, which hereby is heated and can be lead for example to the driving engine of a car in order to heat it before starting or to heat the interior of the car. Excess heat is transferred through the main cooler of the driving engine.

Figure 2:
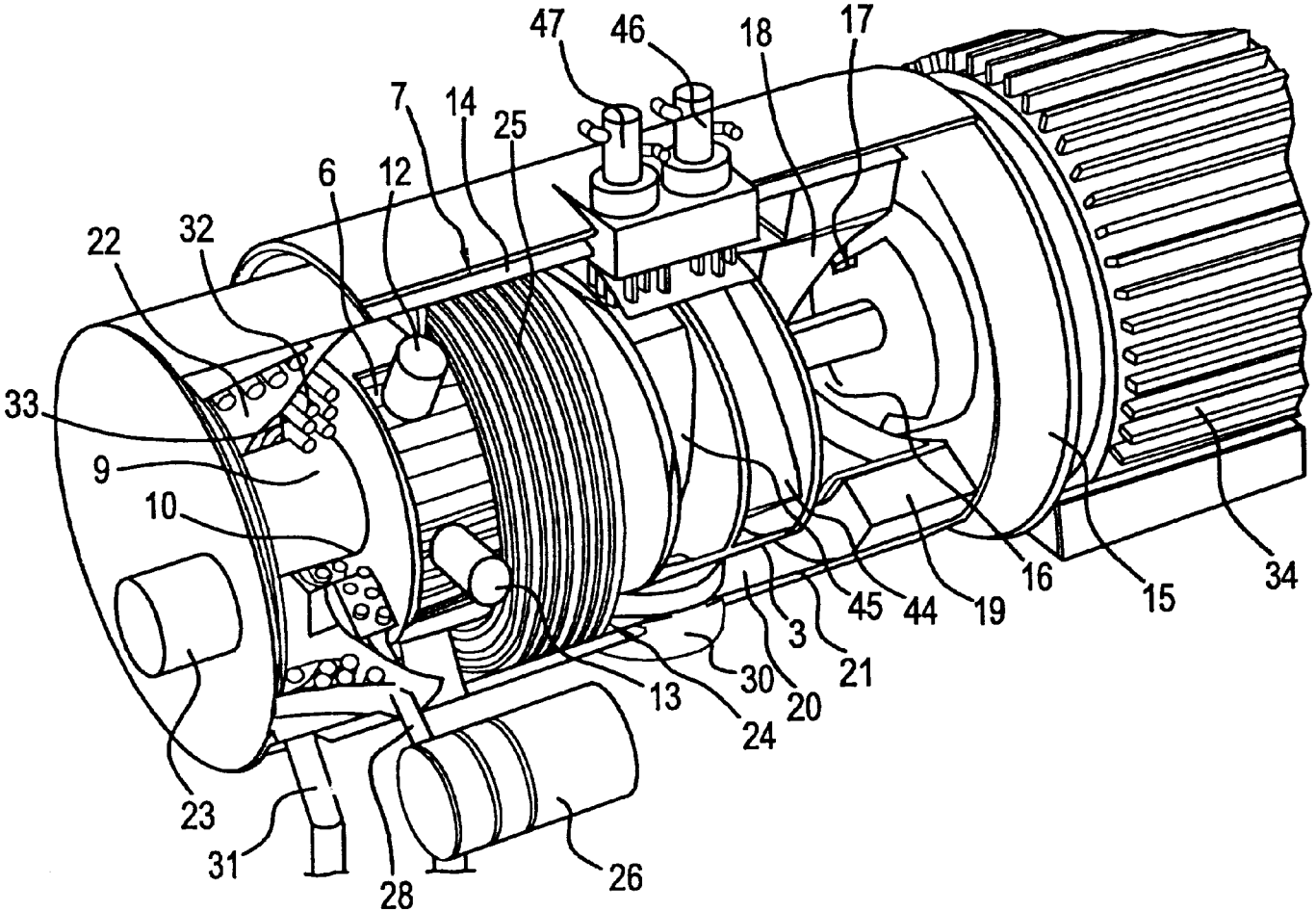
FIG. 2 is a perspective view with part of the housing removed of a steam motor with a rotary piston engine having two rotors.

Towards the right the driving shaft 5 extends through the collecting chamber 16 and the end plate 15 and drives a generator 34 for the generation of electrical energy. This energy can be used for the increasing number of electrical load in a car and other engines in order to avoid the loading of the driving engine itself The energy supply during stand still times of the car can also be secured. The generated heat keeps the driving engine at a temperature which enables a problem free start without a major accumulation of a mixture, whereby the pollutant emissions during the starting phase can be kept at a low level. In FIG. 2 a further steam motor 41 can be shown. It is principally set up in the same way as the steam motor 1 of FIG. 2. That is why the same parts are denoted with the same numerals. For the description of these parts it is referred to the description of FIG. 1. Only the differences with the steam motor 1 according to FIG. 1 are described below.

The steam motor 41 has a rotary piston engine 41 with a housing 3 in which two rotors 44, 45 are arranged adjacent to each other but circumferentially offset which mesh with the driving shaft not shown. According to the number of rotors 44, 45 to steam injectors 46, 47 are arranged above, each steam injector 46, 47 supplying one rotor 44, 45, respectively. The steam generator 24 is arranged between the housing 3 of the rotary piston engine 42 and the connection passages 12, 13 but it is arranged just as the steam motor 1 according to FIG. 1 in the hot gas annular passage 20.

The steam motor 41 according to FIG. 2 is suitable for higher powers because of its arrangement with two rotors 44,45. It is understood, that more than two rotors can also be used.

We claim:

1. A steam motor comprising: a closed steam circuit including steam generator means, piston engine means, steam injector means for injecting high pressure steam from said steam generator into said piston engine means, whereby said piston engine means is driven to generate mechanical power while depressurizing said high pressure steam, condensor means for condensing said depressurized steam to condensed water, and water feeding pump means for feeding said condensed water to said steam generator means; and combustion means and means for supplying fuel to said combustion means for combusting fuel to generate a hot gas stream, and means for supplying said hot gas stream to said steam generator means to heat said condensed water and generating, therefrom, said high pressure steam, wherein said piston engine means comprise a rotary piston machine.

2. A steam motor as claimed in claim 1, and further comprising air feeding means for feeding fresh air to said combustion means through a fresh air passage, said fresh air passage comprising first heat exchanger means passed through by said fresh air and by said depressurized steam for transferring heat from said depressurized steam to said fresh air, and second heat exchanger means passed through by said fresh air and waste gases from said combustion means downstream of said steam generator, whereby said fresh air is pre-heated before reaching said combustion means.

3. A steam motor as claimed in claim 1, wherein said hot gas supplying means comprise an annular hot gas passage surrounding said rotary piston machine and having an outer wall, said hot gas passage communicating with said combustion means, said steam generator means being located within said annular hot gas passage.

4. A steam motor as claimed in claim 3, wherein said steam generator means comprises a circular bundle of tube which is contained within said annular hot gas passage.

5. A steam motor as claimed in claim 3, wherein said combustion means comprise an annular burner.

6. A steam motor as claimed in claim 3, wherein said piston engine means comprise a drive shaft, said air feeding means being mounted on said drive shaft to be driven thereby.

7. A steam motor as claimed in claim 6, wherein said air feeding means comprise a radial compressor having a rotor mounted on said drive shaft and having an inlet and an outlet.

8. A steam motor as claimed in claim 7, wherein said fresh air passage comprises a first axial section substantially coaxial with said drive shaft, said first axial section communicating with said inlet of said radial compressor and a second, annular section communicating with said outlet of said radial compressor.

9. A steam motor as claimed in claim 2, wherein said air feeding means are located on one side of said rotary piston engine and said combustion means are located on the other, opposite side of said rotary piston engine.

10. A steam motor as claimed in claim 2, wherein said fresh air passage comprises an annular section coaxial with said annular hot gas passage and having a partition in common, said partition permitting heat exchange between the hot waste gas in said hot gas passage and the fresh air in said annular section of said fresh air passage, said partition representing said second heat exchanger means.

11. A steam motor as claimed in claim 2, wherein said first heat exchanger is located in said fresh air passage upstream of said air feeding means.

12. A steam motor as claimed in claim 11, wherein said fresh air passage is deflected at least twice upstream of said air feeding means.

13. A steam motor as claimed in claim 1, wherein said combustion means comprise a pore burner, mixing means for generating a mixture of fuel and fresh air and means for directing said mixture to said pore burner.

14. A steam motor as claimed in claim 13, wherein said pore burner comprises a porous body defining pores and having an inlet side and an outlet side, the pores adjacent said inlet side being smaller than the pores adjacent said outlet side, whereby formation of a flame is prevented in a region of said porous body adjacent said inlet side and is permitted in a region within said porous body adjacent said outlet side.

15. A steam motor as claimed in claim 14, wherein said porous body is annular.

16. A steam motor as claimed in claim 15, wherein said annular porous body is located within said hot gas passage, said hot gas passage being annular and surrounding said rotary piston engine.

* * * * *